US007845657B2

(12) United States Patent
Waltz et al.

(10) Patent No.: US 7,845,657 B2
(45) Date of Patent: Dec. 7, 2010

(54) QUICK CHANGE LOAD WHEEL ASSEMBLY

(75) Inventors: Lucas B. Waltz, Coldwater, OH (US); Ryan M. Snodgrass, Celina, OH (US); Kevin A. Gilliland, Coldwater, OH (US); Eric P. Gasser, Findlay, OH (US)

(73) Assignee: Crown Equipment Corporation, New Bremen, OH (US)

( * ) Notice: Subject to any disclaimer, the term of this patent is extended or adjusted under 35 U.S.C. 154(b) by 591 days.

(21) Appl. No.: 11/763,487

(22) Filed: Jun. 15, 2007

(65) Prior Publication Data

US 2008/0308359 A1 Dec. 18, 2008

(51) Int. Cl.
*B66F 9/06* (2006.01)

(52) U.S. Cl. ..... 280/81.1; 280/82; 280/43.12; 280/755; 187/232; 187/222; 16/47; 16/29; 16/30; 301/5.1; 301/36.1; 301/125

(58) Field of Classification Search ..... 187/232, 187/222; 301/5.1, 36.1, 125; 305/132, 134; 280/81.1, 82, 767, 43.12, 755, 676, 47.26, 280/47.27; 16/47, 29, 30
See application file for complete search history.

(56) References Cited

U.S. PATENT DOCUMENTS

| | | | | |
|---|---|---|---|---|
| 1,799,307 A | | 4/1931 | Manley | |
| 2,925,887 A | | 2/1960 | Gibson | |
| 3,246,713 A | * | 4/1966 | Nichols | 180/13 |
| 3,260,534 A | * | 7/1966 | Knights | 280/43.12 |
| 3,265,158 A | * | 8/1966 | Constable | 187/232 |
| 3,638,961 A | | 2/1972 | Larsen | |
| 3,778,080 A | * | 12/1973 | Bilco | 280/676 |
| 3,876,039 A | | 4/1975 | Bushnell, Jr. | |
| 3,950,811 A | | 4/1976 | Larson | |
| 4,086,680 A | | 5/1978 | Kelly | |
| 4,576,391 A | | 3/1986 | Gerstner | |
| 4,669,146 A | | 6/1987 | Saito et al. | |
| 4,813,512 A | | 3/1989 | McCormick | |
| 5,136,751 A | | 8/1992 | Coyne et al. | |
| 5,339,773 A | | 8/1994 | Van Druff | |

(Continued)

FOREIGN PATENT DOCUMENTS

CA 911937 10/1972

(Continued)

OTHER PUBLICATIONS

Crown specification brochure No. SF14502 entitled Crown SP 3400 Series Stockpicker, Apr. 2005, 6 pgs., U.S.A.

(Continued)

*Primary Examiner*—Ruth Ilan
(74) *Attorney, Agent, or Firm*—Stevens & Showalter LLP

(57) ABSTRACT

A load wheel assembly for a materials handling vehicle includes first and second spaced side members, at least one rotatable roller extending between the first and second side members and a retainer for holding the roller in the side members. An interface structure provides a substantially rigid connection between the load wheel assembly and a mounting structure on the materials handling vehicle. The load wheel assembly can be moved vertically or horizontally into a mounted position within the outrigger and at least a portion of the interface structure mates with the mounting structure.

13 Claims, 8 Drawing Sheets

U.S. PATENT DOCUMENTS

| | | | | |
|---|---|---|---|---|
| 5,417,536 | A * | 5/1995 | Cech | 414/21 |
| 5,560,129 | A | 10/1996 | Rothbart | |
| 5,584,363 | A | 12/1996 | Curtin et al. | |
| 5,586,620 | A | 12/1996 | Dammeyer et al. | |
| 5,752,584 | A * | 5/1998 | Magoto et al. | 187/234 |
| 5,940,932 | A | 8/1999 | LaHay | |
| 6,137,398 | A | 10/2000 | Dunlap et al. | |
| 6,138,796 | A | 10/2000 | Herschel | |
| 6,199,665 | B1 | 3/2001 | Eilerman et al. | |
| 6,789,994 | B2 | 9/2004 | Tortellier | |
| D499,853 | S | 12/2004 | Ryan et al. | |
| D505,763 | S | 5/2005 | Greene | |
| 6,904,641 | B2 | 6/2005 | Magoto et al. | |
| 7,162,772 | B2 | 1/2007 | Asher | |
| 2005/0034929 | A1 | 2/2005 | West et al. | |
| 2006/0232030 | A1 * | 10/2006 | Passeri | 280/43.12 |

FOREIGN PATENT DOCUMENTS

| | | | |
|---|---|---|---|
| JP | 2000007294 | A | 1/2000 |
| JP | 2002067963 | A | 3/2002 |
| JP | 2006056647 | A | 3/2006 |

OTHER PUBLICATIONS

Crown specification brochure No. SF12896 entitled Crown RR 5200 Series S Class Narrow-Aisle Reach Truck, Jun. 2005, 6 pgs., U.S.A.

* cited by examiner

QUICK CHANGE LOAD WHEEL ASSEMBLY

FIELD OF THE INVENTION

The present invention relates generally to materials handling vehicles such as forklift trucks and, more particularly, to a quick change load wheel assembly that may be quickly mounted on and removed from a straddle arm or an outrigger on a materials handling vehicle.

BACKGROUND OF THE INVENTION

Forklift trucks, such as rider reach and stock picker trucks, are typically provided with a pair of forwardly extending straddle arms mounted outside of vertically movable forks of the trucks where they do not impede lowering of the forks to the floor, and do not interfere with any load supported upon the forks. The straddle arms each carry one or more load wheels to support the weight of the truck and any load carried by the forks. After use over a period of time, the load wheels normally experience wear or may become damaged and require replacement.

A known construction for a base leg assembly for a straddle arm including load wheels for a lift truck is illustrated in U.S. Design Pat. Nos. D505,763 and D499,853 and also in U.S. Patent Application Publication No. 2005/0034929 A1. The base leg assembly has a mounting plate, a base leg and a load wheel assembly. The base leg has an integrally cast mounting portion and a leg portion that extends laterally from the mounting portion and transitions in direction approximately 90° such that the leg portion extends forward of the mounting portion and the lift truck at its distal end. A load wheel assembly includes a pair of load wheel plates which are mirror images of each other and have inner surfaces that engage the outer surface of the distal end of the leg portion of the base leg. The load wheel plates are fastened to the base leg using threaded fasteners. An elongated aperture extends transversely through each load wheel plate and receives load wheels. The elongated apertures are shaped such that they can receive different numbers, sizes, and types of load wheels which are disposed between the load wheel plates and supported such that they can rotate.

In order to remove the load wheel assembly from the straddle arm, the fasteners securing the load wheel plates to the leg portion of the base leg are removed to release the wheel plates. For reassembly, load wheels of a required size and type are disposed between the load wheel plates which are then moved into position so that the plates can be resecured to the leg portion of the base leg by the fasteners that were previously removed. Since this type of repair is typically performed in the field, it can be difficult and require care in manipulating the load wheels and load wheel plates for reinstallation.

In another configuration for mounting load wheels to a straddle arm, a mounting structure comprising a weldment having spaced bearing plates is located at the end of the straddle arm. Pivot plates located in apertures in each of the bearing plates support wheel axles for two spaced wheels. In order to replace the wheels, the axles must be removed, resulting in release of the wheels as well as various washers and bearings supported on the wheels and axles. A repair operation performed in the field can be difficult in that the procedure for assembling replacement wheels into the bearing plate requires manipulating various parts onto the axles as the axles are moved into position in the pivot plates. Such a repair operation can be further complicated by the location of the of load wheel structure adjacent the floor surface limiting access to the parts positioned between the bearing plates.

SUMMARY OF THE INVENTION

In accordance with one aspect of the present invention, load wheel assembly for a materials handling vehicle comprises first and second side support members spaced laterally from one another. At least one roller is mounted for rotation between the first and second side support members to define at least one load wheel. A retainer holds the at least one roller to the first and second side support members and interface structure coupled to the first and second side support members has at least a portion that mates with mounting structure on a materials handling vehicle to provide a substantially rigid connection between the interface structure and the mounting structure and thereby to the materials handling vehicle.

In accordance with another aspect of the invention, a materials handling vehicle having a quick change load wheel comprises a frame, a mast assembly coupled to the frame and a pair of straddle arms coupled to the frame and extending from a front of the vehicle. Each of the straddle arms includes mounting structure for receiving a quick change load wheel which comprises a first side support member and a second side support member spaced laterally from the first said support member. Interface structure is coupled to the first and second side support members and at least one roller is mounted for rotation between the first and second side support members to define at least one load wheel. A retainer holds the at least one roller to the first and second side support members. The interface structure has at least a portion that mates with the mounting structure to provide a substantially rigid connection between the interface structure and the mounting structure and thereby to the materials handling vehicle. In accordance with yet another aspect of the invention, a method of changing a load wheel assembly having at least one roller mounted for rotation on a laterally extending axle to define a load wheel on an outrigger for a materials handling vehicle comprises: disengaging at least one fastener extending between said outrigger and load wheel assembly; moving an original wheel assembly out of engagement with said outrigger; moving a replacement wheel assembly into engagement with said outrigger; and engaging said at least one fastener between said replacement wheel assembly and said outrigger to maintain said wheel assembly in engagement with said outrigger.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
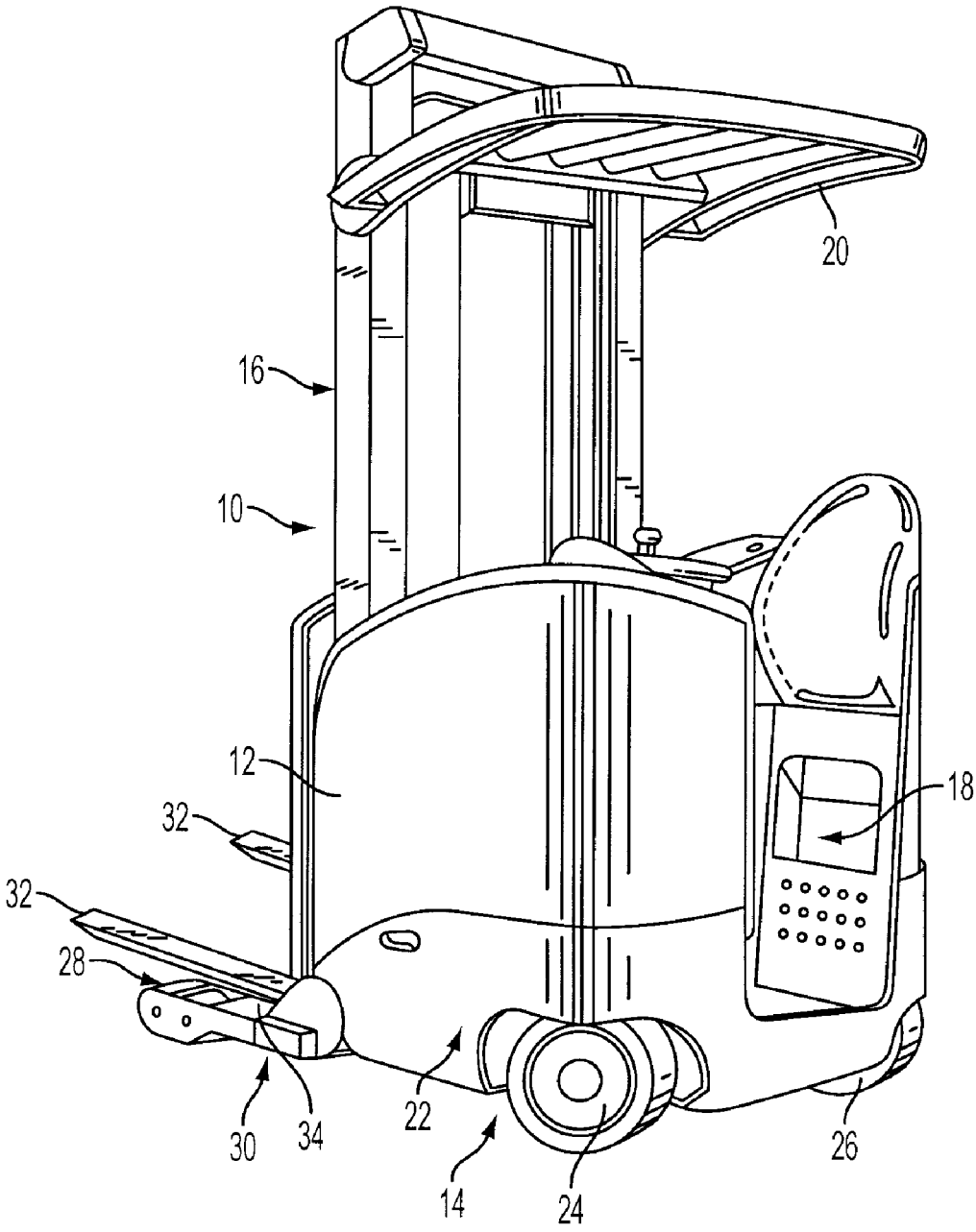
FIG. 1 is a perspective view of a typical forklift truck incorporating the present invention.

Reference is now made to FIG. 1 which shows a materials handling vehicle incorporating the present invention. The vehicle comprises, in the illustrated embodiment, a rider reach forklift truck 10. The truck 10 includes a frame 12, a drive mechanism 14 supported on the frame 12, a mast assembly 16 coupled to the frame 12, an operator's compartment 18 and an overhead guard 20. The drive mechanism 14 includes a power unit 22 which houses a battery (not shown) for supplying power to a traction motor (not shown) connected to a steerable, powered wheel 24 and to hydraulic motors (not shown) which supply power to several different systems.

The truck is supported at four points which are provided by the steerable, powered wheel 24 located at the left rear of the power unit 22, a caster wheel 26 located at the right rear of the power unit 22, and two load wheel assemblies 28 supported on a pair of straddle arms 30 (only one of which, the left straddle arm, is shown in FIG. 1) extending from the power unit 22 at the front of the truck 10. The straddle arms 30 are attached to the power unit 22 so that they extend outwardly beyond the sides of the mast assembly 16 to allow a pair of forks 32 to be lowered to the floor between the straddle arms 30 without interference, and so that the straddle arms 30 do not interfere with any load supported on the forks.

Figure 2:
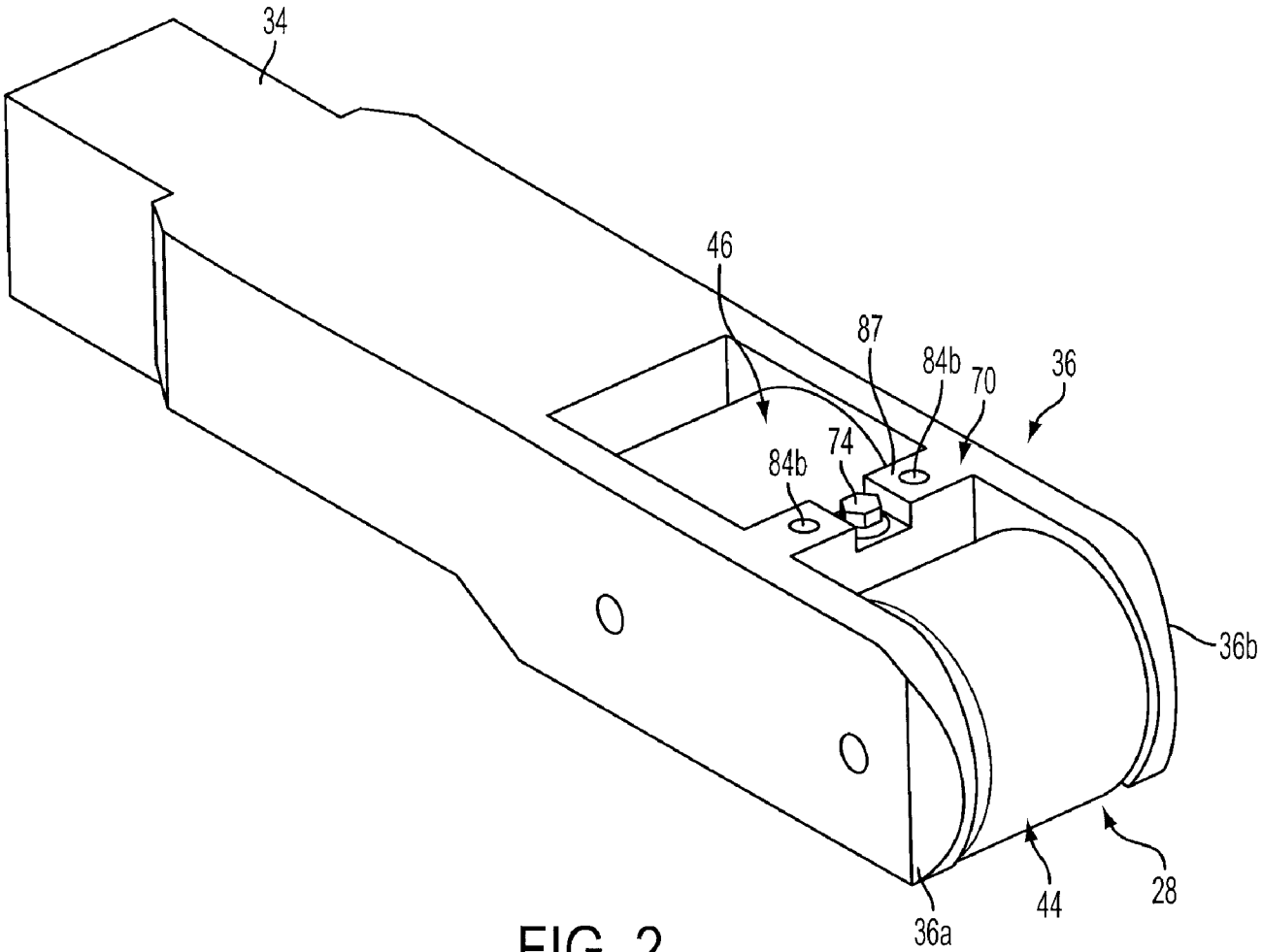
FIG. 2 is a perspective view of the end of a straddle arm of the forklift truck of FIG. 1.

Referring additionally to FIG. 2, each straddle arm 30 comprises a forwardly extending solid steel bar or arm member 34. A load bearing structure 36 comprising a pair of bearing plates 36*a*, 36*b* is located at the forward end of the arm member 34 with the load wheel assembly 28 supported between the pair of bearing plates 36*a*, 36*b*. The bearing plates 36*a*, 36*b* are illustrated as being a solid extension of the arm member 34 for example by having the bearing plates 36*a*, 36*b* and arm member 34 comprise a weldment or by being cast as a single integral unit. However, it should be understood that the present invention is not limited to a particular structure for providing the bearing plates 36*a*, 36*b* at the end of the arm member 34. The bearing plates 36*a*, 36*b* may comprise, for example, separate plate members that are attached to the end of the arm member 34, such as by bolting individual bearing plates 36*a*, 36*b* to the arm member 34. In any event, the assembly and disassembly operations described for the load wheel assemblies 28 do not require removal or reattachment of the bearing plates 36*a*, 36*b* from or to the arm member 34.

Figure 3:
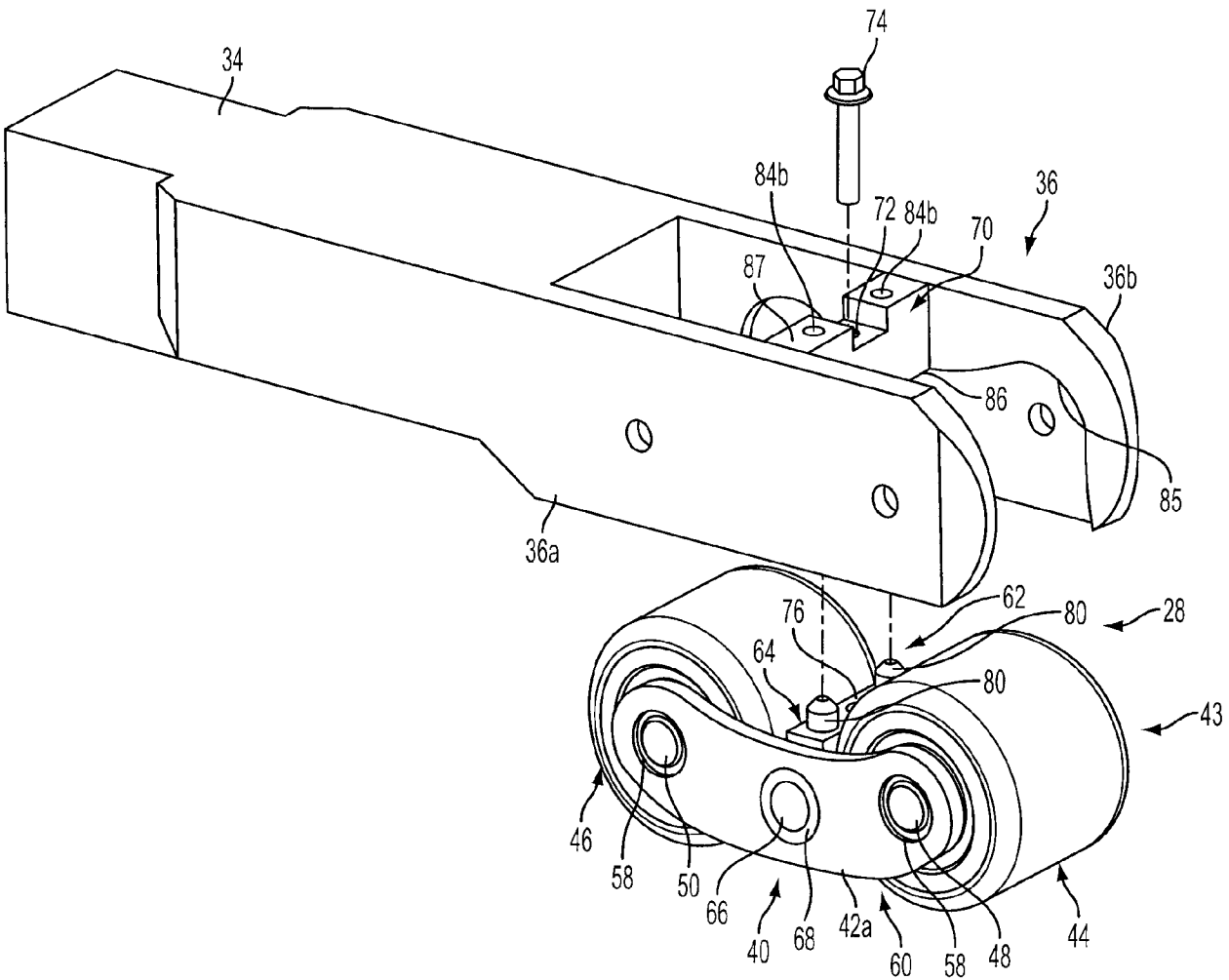
FIG. 3 is a view similar to FIG. 2 with a load wheel assembly disassembled from the straddle arm.
Figure 4:
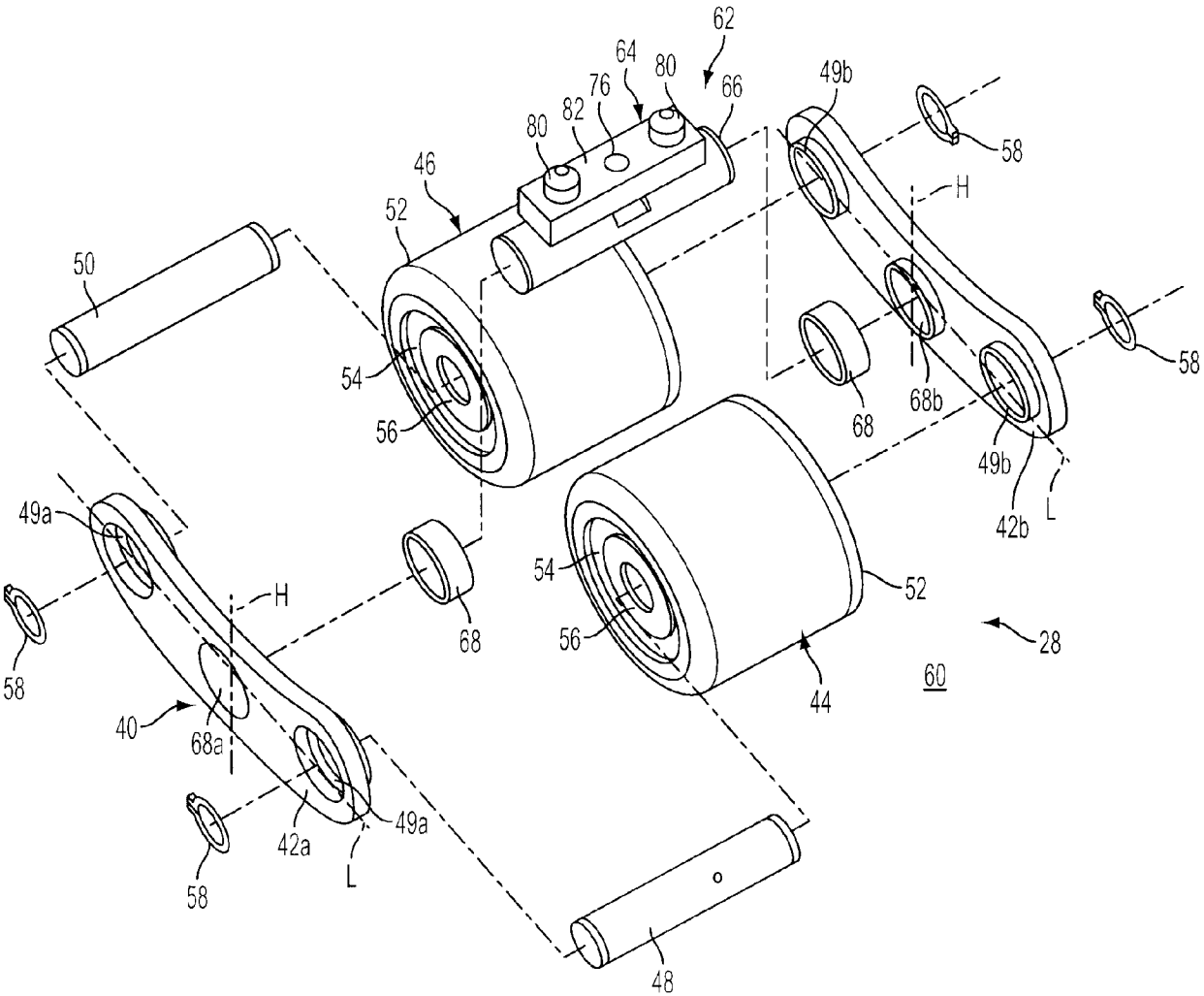
FIG. 4 is an exploded perspective view of the load wheel assembly.

Referring to FIGS. 3 and 4, the illustrated load wheel assembly 28 includes a first side member 42*a* and a second side member 42*b* located in laterally spaced relation to the first side member 42*a*. The side members 42*a*, 42*b* are elongated having a major longitudinal axis L and a minor height axis H. First and second rollers or wheels 44, 46 are supported for rotation on respective first and second axles 48, 50 to define a roller structure 43. The first and second axles 48, 50 extend transversely between the side members 42*a*, 42*b* with the ends of the axles 48, 50 being received within openings 49*a*, 49*b* in the respective side members 42*a*, 42*b*. Each of the wheels 44, 46 may comprise known load wheels including a tire 52 supported on a hub portion 54 which includes a bearing 56 for engaging with a respective axle 48, 50. It should be noted that the roller structure 43 may comprise structure other than that specifically described herein, and the roller structure 43 may comprise any load carrying assembly that provides a floor engaging component for reducing resistance between the straddle arm 30 and the floor as the truck 10 is maneuvered across the floor. Further, while two wheels 44, 46 are shown in the illustrated embodiment, the roller structure can have a single wheel or more than two wheels as required for a given application.

The roller structure 43 is maintained in the side members 42*a*, 42*b* by a retainer illustrated as comprising a type of snap ring 58 known as circlips snapped into annular slots at the ends of the axles 48, 50. Alternately, retention structure can comprise other fastening devices associated with the axles 48, 50 or the side members 42*a*, 42*b* as will be apparent to those skilled in the art. The retention structure can even simply be tape secured to cover the openings 49*a*, 49*b* in the respective side members 42*a*, 42*b* or wrapped around the roller structure 43 and the side members 42*a*, 42*b* prior to installation. Whatever retainer or retention structure is used, the assembly comprising the roller structure 43 and the retained side members 42*a*, 42*b* define an assembled roller unit 60 for the load wheel assembly 28.

The load wheel assembly 28 further includes an interface structure 62 for providing a substantially rigid connection between the load bearing structure 36 and the assembled roller unit 60. In the illustrated embodiment, the interface structure 62 comprises a block member 64 rigidly attached to a pivot pin 66. The block member 64 may be attached to the pivot pin 66 by any conventional method, for example by welding, or the block member 64 and pivot pin 66 may be formed as a unitary member. The pivot pin 66 extends transversely to the longitudinal axis L and the height axis H, and is mounted for rotation to the frame structure 40 at pivot apertures 68*a*, 68*b* formed in the respective side members 42*a*, 42*b*, generally centrally of the side members 42*a*, 42*b*, i.e., between the first and second wheels 44, 46 as illustrated. The ends of the pivot pin 66 are engaged with bearing members 68 located within the pivot apertures 68*a*, 68*b*. The pivot pin 66 forms a pivot structure about which the assembled roller unit 60 may pivot.

Figure 3A:
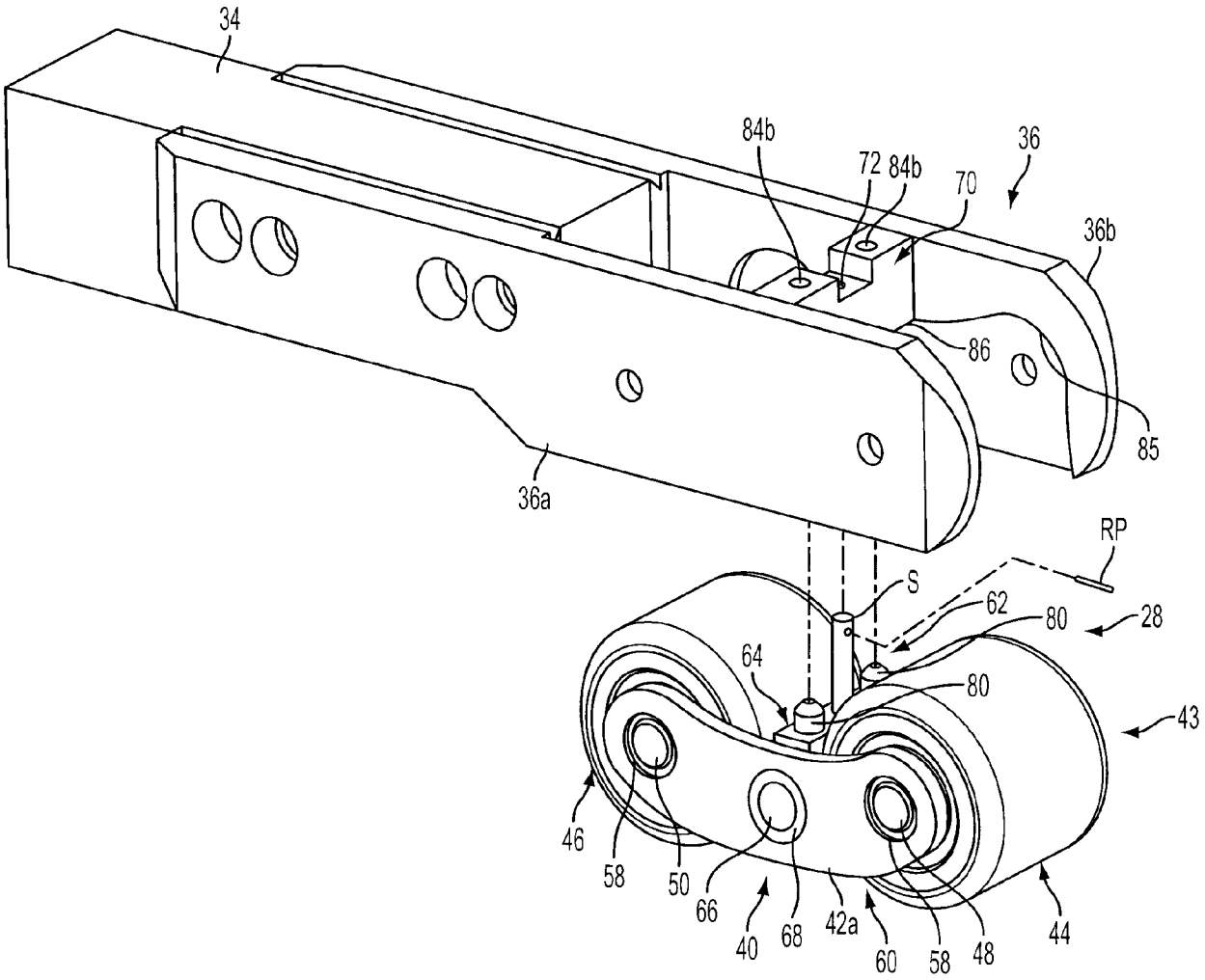
FIGS. 3*a* and 3*b* are views similar to FIG. 3 but illustrating removable bearing plates and an alternate fastener and interface structure.

Referring to FIGS. 2 and 3, the load bearing structure 36 includes a mounting structure comprising a transverse bar 70 extending between and rigidly attached to the bearing plates 36*a*, 36*b*. The bearing plates 36*a*, 36*b* and bar 70 can be connected to one another by welding or alternately could be formed as a single casting or part. The bar 70 includes an aperture 72 through which a threaded fastener 74 of the interface structure 62 may extend to engage a threaded aperture 76 defined through an upper surface 82 of the block member 64. Thus, as illustrated in FIGS. 2-4, a single, downwardly inserted bolt secures the wheel assembly 28 to the load bearing structure 36. It is noted that a bolt could be inserted upwardly with the aperture 72 being threaded to receive the bolt and other fasteners can be used to secure the wheel assembly to the load bearing structure 36. For example, a stud S can be formed on either the wheel assembly 28 or the bar 70 to be received in a receiving aperture in the other structure with the stud S being secured by means of a roll pin RP or otherwise, see FIG. 3*a*. FIG. 3*a* also illustrates individual bearing plates 36*a*, 36*b* which can be bolted to the arm member 34.

Figure 5:
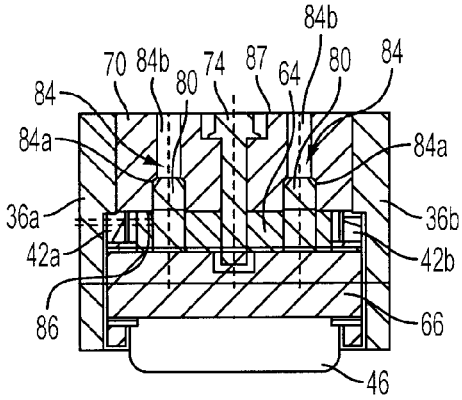
FIG. 5 is an enlarged cross-sectional view taken along line 5-5 in FIG. 6.

Referring to FIG. 5, the bar 70 includes a pair of holes 84, where each hole 84 comprises a lower hole portion 84*a* extending upwardly from a lower surface 86 of the bar 70, and a smaller diameter upper hole portion 84*b* extending upwardly from the lower hole portion 84*a* to an upper surface 87 of the bar 70. The block member 64 includes a pair of pins 80 extending upwardly from its upper surface 82 for engaging within the lower hole portions 84*a* of the bar 70. Each of the bearing plates 36*a*, 36*b* additionally includes a downwardly facing cutout area 85 (only one shown in FIG. 3) for receiving correspondingly structured upper surfaces of the side members 42*a*, 42*b*, and the bearing plates 36*a*, 36*b* and bar 70 define a downwardly facing opening of the load bearing structure 36. During an operation to mount the load wheel assembly 28 to the load bearing structure 36, the load wheel assembly 28 and side members 42*a*, 42*b* are moved relative to one another to position the side members 42*a*, 42*b* into the cutout areas 85. In addition, the upper surface 82 of the block member 64 moves into engagement with the lower surface 86 of the bar 70, see FIG. 3.

The pins 80 slide into openings of the lower hole portions 84*a* at the lower surface 86 of the bar 70 and include tapered ends to facilitate alignment of the block member 64 to the bar 70 so that the aperture 76 in the block member 64 is aligned to the aperture 72 in the bar 70. The fastener 74 may then be inserted through the aperture 72 and threadably engaged in the aperture 76 to retain the block member 64 in engagement with the bar 70. The pins 80 provide structure that, in combination with the fastener 74, substantially prevent relative shearing movement between the block member 64 and the bar 70, and further resist side-to-side movement of the assembled wheel unit 60 relative to the load bearing assembly 36.

Figure 3B:
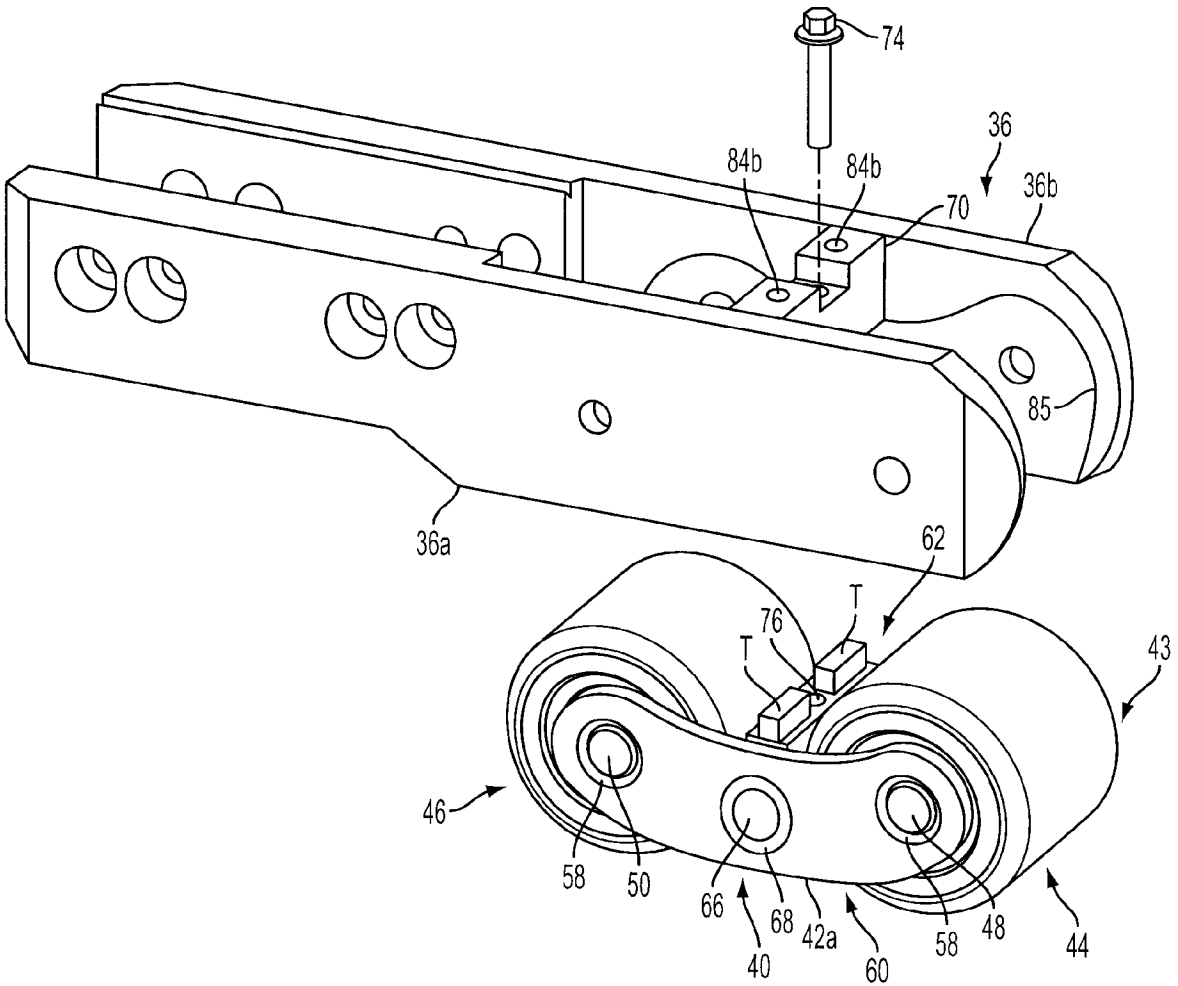

Other arrangements for substantially preventing relative shearing movement between the block member 64 and the bar 70 will be apparent to those skilled in the art. For example, a tenon T and mortis (not shown) joint is illustrated in FIG. 3*b*. FIG. 3*b* also illustrates individual bearing plates 36*a*, 36*b* which can be bolted to the arm member 34.

As noted above, alternative configurations for attaching the block member 64 to the bar 70 include, for example, inserting the fastener 74 upwardly through the block member 64 and threadably engaged it with the bar 70 and a stud and roll pin. Other attachment arrangements will be apparent to those skilled in the art in view of this description.

Figure 6:
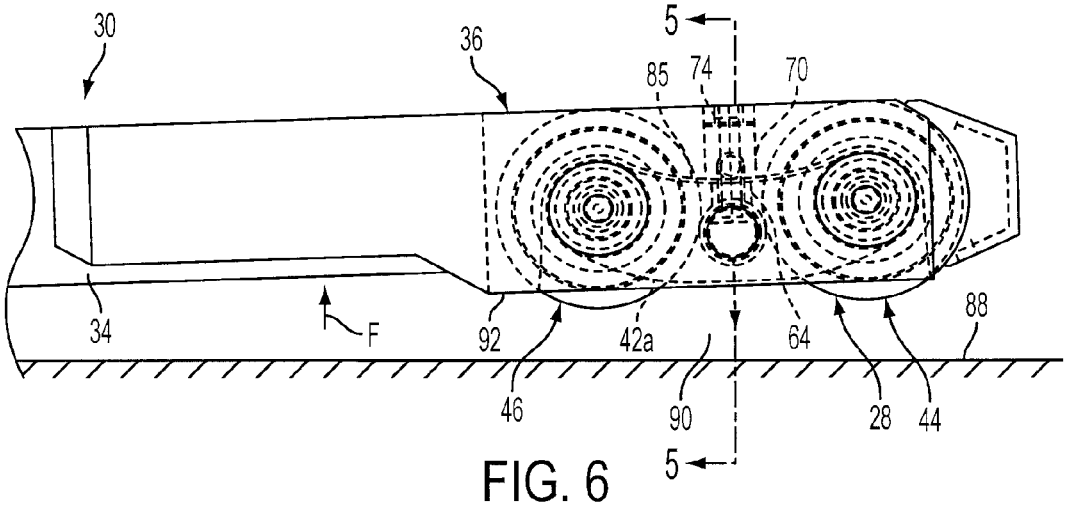
FIG. 6 is a side elevational view of an end portion of the straddle arm illustrating a position for replacement of the load wheel assembly.

Reference to FIG. 6 will now be made to describe an operation for replacing a load wheel assembly 28. The end of the straddle arm 30 may be initially lifted from the floor surface 88, such as by application of a lifting force F to a portion of the straddle arm 30, to create an access space 90 between the floor surface 88 and the lower edge 92 of the load bearing structure 36. The fastener 74 may be removed to permit the block member 64 to separate from the bar 70 and to permit the load wheel assembly 28 to be lowered downwardly as an assembled unit from the load bearing structure 36. A punch and hammer can be used in holes 84*b* to assist removal. A replacement load wheel assembly 28 may then be inserted by moving it into the access space 90 and positioning it upwardly into engagement with the load bearing structure 36, as described above.

Alternately, the fastener 74 can be first removed and the straddle arm 30 lifted so that the straddle arm is lifted off of the wheel assembly 28. The replacement load wheel assembly 26 is then positioned in the access space 90 and the end of the straddle arm 30 may be lowered to bring the bar 70 of the load bearing structure 36 into engagement with the block member 64 of the load wheel assembly 28.

In either event, at least one fastener extending between the straddle arm or outrigger and load wheel assembly is disengaged and an original wheel assembly is moved out of engagement with the outrigger. A replacement wheel assembly is moved into engagement with the outrigger and the at least one fastener is engaged between the replacement wheel assembly and the outrigger to maintain the wheel assembly in engagement with the outrigger.

Figure 7:
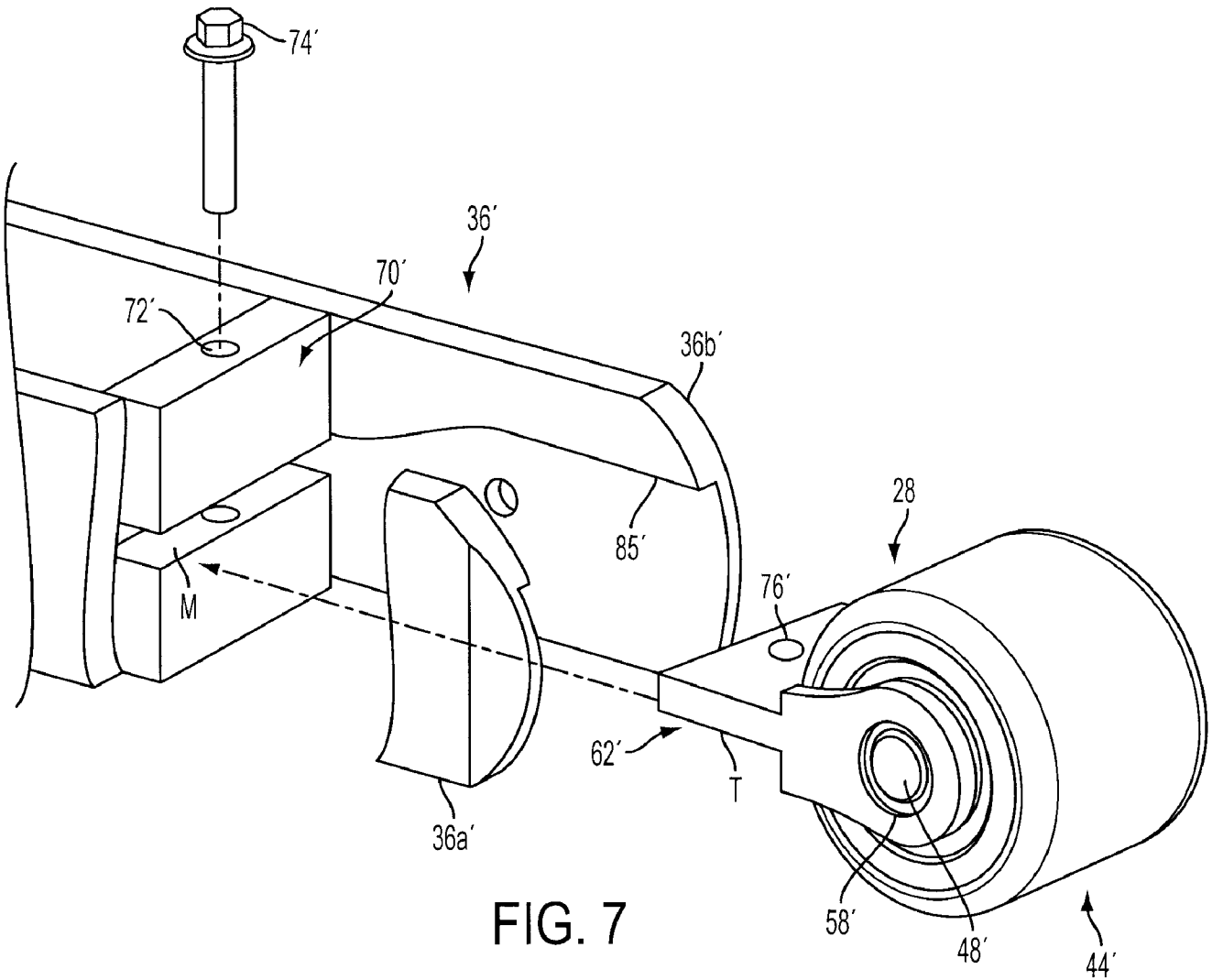
FIG. 7 is a perspective view of a load wheel assembly incorporating the present invention and having a single wheel inserted horizontally into load bearing structure.

While the illustrated embodiments to this time have relied on vertical movement between a wheel assembly and the load bearing structure, it should be apparent that horizontal movement may also be used to remove and replace a load wheel assembly. Such horizontal movement would require less elevation of the load bearing structure and the movement between the load wheel assembly and the load bearing structure could be sideways or from the front of the load bearing structure. For example, a load wheel assembly 28' having a single wheel 44' is shown in FIG. 7 as being inserted into the load bearing structure 36' with the load wheel assembly 28' having a tenon T that mates with a mortis M on the load bearing structure 36'. The components in FIG. 7 that correspond to similar elements in the previously described embodiments are labeled with the same reference numerals primed.

It can be seen from the above description that the structure for the present load wheel assembly 28 provides an efficient load wheel replacement operation in that an uncomplicated interface structure 62 is provided comprising, for example, the single fastener 74 engaged with the block member 64 for attachment and removal of the load wheel assembly 28, requiring minimal manipulation of parts during a replacement or repair operation. Further, the pins 80 or tenon T of the interface structure 62 readily engage with the holes 84 or mortis M of the bar 70 to facilitate positioning of the load wheel assembly 28 relative to the load bearing structure 36, while also strengthening the connection between the two components.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A load wheel assembly for a materials handling vehicle comprising:

first and second side support members spaced laterally from one another;

at least one roller mounted for rotation between said first and second side support members to define at least one load wheel;

an axle supporting said at least one roller to said first and second side support members; and interface structure comprising a block member extending laterally between said first and second side support members, said interface structure having at least a portion that engages and mates with mounting structure on a materials handling vehicle to provide a substantially rigid connection between said interface structure and said mounting structure and thereby to said materials handling vehicle;

the engagement of said interface structure with said support structure comprising a vertical engagement for horizontally aligning and preventing horizontal shearing movement of said interface structure relative to said mounting structure.

2. The assembly of claim 1, wherein said side support members comprise elongated members having a major longitudinal axis and a minor height axis transverse to said longitudinal axis, and said at least one roller comprises at least first and second rollers that are spaced from each other along said longitudinal axis.

3. The assembly of claim 2, including a pivot aperture formed in each of said side support members generally central of said first and second side support members for receiving a pivot structure extending transversely to said longitudinal and height axes for pivoting movement of said assembly about said pivot structure.

4. The assembly of claim 3, wherein said pivot structure comprises a pivot pin extending transversely between said side members.

5. The assembly of claim 4, wherein said interface structure is supported on said pivot pin for attaching said pivot pin to said mounting structure.

6. The assembly of claim 5, wherein said block member is rigidly attached to said pivot pin, said block member and said mounting structure including assembly attachment apertures for receiving a fastener to secure said block member to said mounting structure.

7. The assembly of claim 6 wherein said fastener comprises a threaded fastener and at least one of said attachment apertures is threaded to receive said threaded fastener therein.

8. The assembly of claim 7, wherein said interface structure and said mounting structure include pins and mating apertures to resist horizontal movement of said interface structure and said mounting structure relative to one another and to assist in alignment of the interface structure and the mounting structure during installation of said load wheel assembly into said materials handling vehicle.

9. The assembly of claim 5, wherein said block member is rigidly attached to said pivot pin, one of said block member and said mounting structure including an assembly attachment aperture and another of said block member and said mounting structure including said fastener so that said fastener is received in said attachment aperture to secure said block member to said mounting structure.

10. The assembly of claim 1, wherein said mounting structure includes an aperture for receiving a fastener, said fastener extending between said block member and said mounting structure for detachably securing said block member to said mounting structure.

11. A materials handling vehicle having a quick change load wheel and comprising:

a frame;

a mast assembly coupled to said frame;

a pair of straddle arms coupled to said frame and extending from a front of said vehicle, each of said straddle arms including mounting structure for receiving a quick change load wheel comprising:

a first side support member;

a second side support member spaced laterally from said first said support member;

interface structure comprising a block member extending laterally between said first and second side support members;

at least one roller mounted for rotation between said first and second side support members to define at least one load wheel; and an axle supporting said at least one roller to said first and second side support members;

said interface structure has at least a portion that engages and mates with said mounting structure to provide a substantially rigid connection between said interface structure and said mounting structure and thereby to said materials handling vehicle;

the engagement of said interface structure with said support structure comprising a vertical engagement for horizontally aligning and preventing horizontal shearing movement of said interface structure relative to said mounting structure.

12. The assembly of claim 11, wherein said mounting structure includes an aperture for receiving a fastener, said fastener extending between said block member and said mounting structure for detachably securing said block member to said mounting structure.

13. A load wheel assembly for a materials handling vehicle comprising:

first and second side support members spaced laterally from one another, said side support members comprising elongated members having a major longitudinal axis;

first and second rollers, said rollers mounted for rotation between said first and second side support members to define first and second load wheels, said rollers spaced from each other along said longitudinal axis;

an axle supporting each of said rollers to said first and second side support members;

interface structure comprising a block member and a pivot structure, said interface structure having at least a portion that mates with mounting structure on a materials handling vehicle to provide a substantially rigid connection between said interface structure and said mounting structure and thereby to said materials handling vehicle;

said pivot structure including pivot pin ends extending from said block member for engaging respective pivot apertures in said side support members for pivoting movement of said assembly about said pivot structure; and said block member and said mounting structure including assembly attachment apertures for receiving a fastener to secure said block member to said mounting structure.

* * * * *